United States Patent [19]

Itou et al.

[11] Patent Number: 4,900,984

[45] Date of Patent: Feb. 13, 1990

[54] CATHODE RAY TUBE WITH ANTISTATIC FILM ON FRONT PANEL

[75] Inventors: Takeo Itou, Fukaya; Hidemi Matsuda, Oomiya; Mamory Yoshizako, Machida; Osamu Yagi, Kawasaki, all of Japan

[73] Assignees: Kabushiki Kaisha Toshiba, Kawasaki; Tama Chemicals Co., Ltd., Tokyo, both of Japan

[21] Appl. No.: 187,005

[22] Filed: Apr. 27, 1988

[30] Foreign Application Priority Data

Apr. 28, 1987 [JP] Japan ..... 62-103049

[51] Int. Cl.[4] ..... H01J 29/86

[52] U.S. Cl. ..... 313/479; 313/313

[58] Field of Search ..... 313/479, 477 R, 313; 427/165, 167, 126.2; 358/245, 247

[56] References Cited

U.S. PATENT DOCUMENTS 4,563,612 1/1986 Deal et al. ..... 313/479 X
4,785,217 11/1988 Matsuda et al. ..... 313/479

FOREIGN PATENT DOCUMENTS 59-96638 6/1984 Japan ..... 313/479
61-16452 1/1986 Japan .
61-45545 3/1986 Japan .

*Primary Examiner*—Donald J. Yusko
*Assistant Examiner*—Michael Horabik
*Attorney, Agent, or Firm*—Cushman, Darby & Cushman

[57] ABSTRACT

A cathode ray tube according to the present invention has a sufficient antistatic property which can be obtained by forming a glass film containing $SiO_2$ or $P_2O_5$ as a main component and a hygroscopic metal salt on the outer surface of its front panel.

5 Claims, 5 Drawing Sheets

CATHODE RAY TUBE WITH ANTISTATIC FILM ON FRONT PANEL

BACKGROUND OF THE INVENTION

1. Field of the Invention

The present invention relates to a cathode ray tube and, more particularly, to a cathode ray tube having an antistatic function.

2. Description of the Related Art

Since the outer surface of a front panel of an envelope of a cathode ray tube has a high surface electric resistance, a static charge accumulates during an operation of the cathode ray tube. This causes inconveniences. For example, dust adheres on the outer surface or an electrical shock is inflicted on a person.

In order to eliminate such inconveniences, Japanese Patent Disclosure No. 61-16452 discloses a cathode ray tube having a transparent thin film composed of a silicate and an inorganic metallic compound of a metal such as platinum, palladium, tin and gold, and formed on the outer surface of its front panel. However, since the silicate in the thin film is not conductive, the surface electric resistance of the thin film cannot be sufficiently decreased. Therefore a sufficient antistatic effect cannot be obtained.

According to the tests performed by the present inventors, when an inorganic metallic compound was not hygroscopic, a thin film was not conductive. When a hygroscopic inorganic metallic compound such as $PdCl_2$ was added, a low conductivity was obtained. However, when the content of the compound was increased so as to obtain sufficient conductivity, the strength and optical characteristics of the thin film were greatly degraded.

In order to increase the strength of a reflection-free thin film formed on the outer surface of a front panel of an envelope of a cathode ray tube, Japanese Patent Disclosure No. 61-45545 proposes to add an oxide or a hydroxide of a metal such as Ti, Al, Mg, Ca, Zr, Na, and K in the film. However, since it is considered that metal atoms in the oxide or hydroxide are present where Si—O—Si bonds of the skeleton structure of a film-forming material such as $SiO_2$, are fragmented as in FIG. 1, the oxide or hydroxide cannot obtain hygroscopicity. Therefore, the resultant film cannot be used as a film required to have conductivity.

SUMMARY OF THE INVENTION

According to a cathode ray tube according to the present invention, a sufficient antistatic property can be obtained by forming a glass film containing $SiO_2$ or $P_2O_5$ as a main component and a hygroscopic metal salt on the outer surface of its front panel.

DETAILED DESCRIPTION OF THE PREFERRED EMBODIMENTS

Figure 1:
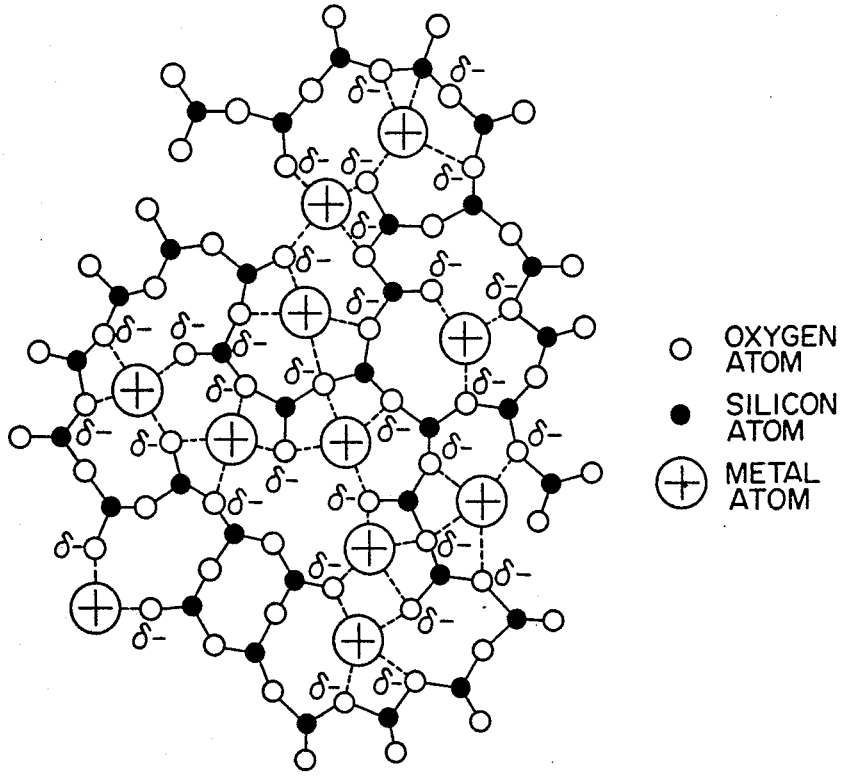
FIG. 1 (PRIOR ART)
FIG. 1 shows an atomic model of a conventional antistatic glass film for a cathode ray tube.
Figure 2:
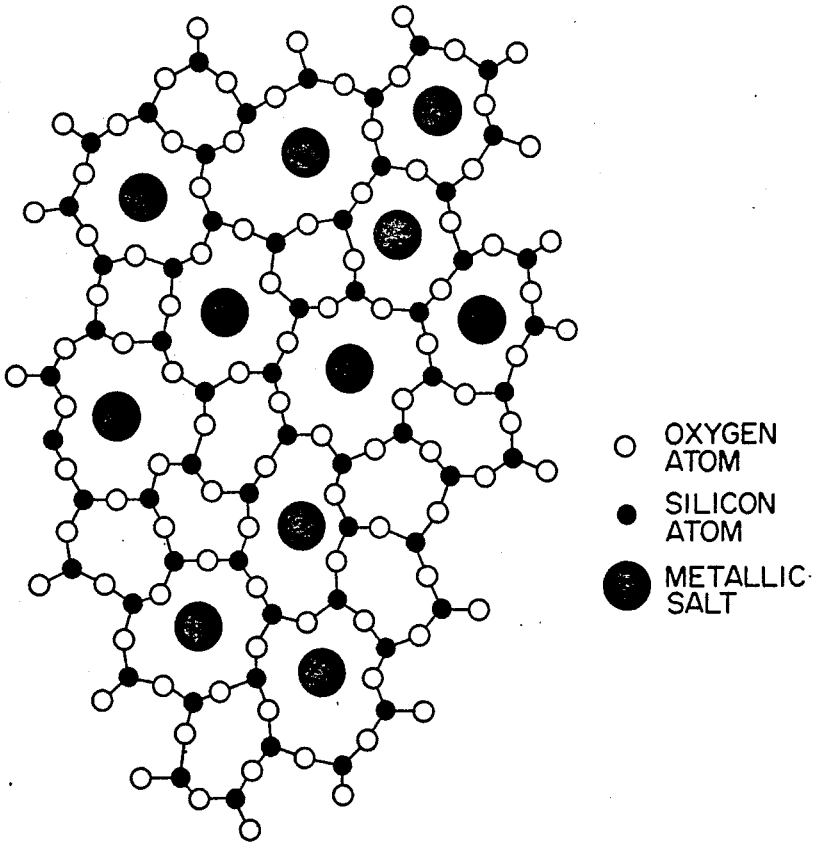
FIG. 2 shows an atomic model of an antistatic glass film according to an embodiment of the present invention.

According to the present invention, as illustrated in FIG. 2, a hygroscopic metallic salt is sealed in the interstices of the skeleton structure (Si—O—Si bonds) of a glass film, and the metal salt absorbs moisture in the air, thereby decreasing the electric resistance of the glass film.

The electric resistance of the glass film can be decreased even if the hygroscopic metal salt is not sealed in the above-described manner. However, it is preferable that the hygroscopic metal salt is sealed in the above-described manner so as to be firmly fixed in the glass film. In order to seal the metal salt in the above-described manner, its size must be small. If the size of the metal salt is excessively large, it causes the glass skeleton to break, and the strength of the film is thereby decreased. Consequently, the metal salt cannot be added in an amount necessary to obtain a sufficient conductivity.

The thickness of a glass film is preferably 0.05 to 1 μm. If it is smaller than 0.05 μm, the electric resistance of the film cannot be stabilized. On the other hand, if it is larger than 1 μm, it becomes difficult to uniformly form the film, thereby causing the focus of an image to blur.

Table 1 shows the strength of each film when a corresponding metal salt is contained in an amount sufficient for obtaining a film resistance of $5\times10^{10}\Omega/cm^2$. The film strength was determined by a rubbing test of a corresponding film using an eraser, i.e., Lion No 50-30 (trademark) to which a load of 200 $g/cm^2$ was applied. The film strength was represented by the number of times reciprocal rubbing motions could be repeatedly applied until the film peeled. It is found from Table 1 that the strength of the film tends to increase as the atomic number of metallic elements in a metal salt is decreased. Practical metal salts (having strengths of 60 or more times) are those containing metallic elements having atomic numbers which are smaller than that of Ga (31). Although the metal salts are represented as anhydrous salts in Table 1, some of them can be hydrous salts.

TABLE 1

| Metallic Element | Atomic Number | Film Strength (number of times) (Chloride) | (Nitrate) | (Sulfate) |
|---|---|---|---|---|
| Li | 3 | 100 or more ($LiCl$) | 100 or more ($LiNO_3$) | — |
| Be | 4 | 100 or more ($BeCl_2$) | — | — |
| Ca | 20 | 90 ($CaCl_2$) | 85 ($Ca(NO_3)_2$) | — |
| Sc | 21 | 70 ($ScCl_3$) | 65 ($Sc(NO_3)_3$) | — |
| Mn | 25 | 80 ($MnCl_2$) | — | — |
| Fe | 26 | 75 ($FeCl_2$) 65 ($FeCl_3$) | 60 ($Fe(NO_3)_3$) | 60 ($Fe(SO_4)_3$) |
| Ni | 28 | 70 ($NiCl_2$) | 65 ($Fe(NO_3)_2$) | 70 ($NiSO_4$) |
| Cu | 29 | 70 ($CuCl_2$) | 65 ($Cu(NO_3)_2$) | — |
| Zn | 30 | 70 ($ZuCl_2$) | — | — |
| Ga | 31 | 65 ($GaCl_3$) | 65 ($Ga(NO_3)_3$) | 60 ($Ga_2(SO_4)_3$) |
| Rb | 37 | — | 55 ($RbNO_3$) | — |
| Sr | 38 | 50 ($SrCl_2$) | — | — |
| Mo | 42 | 40 ($MoCl_5$) | — | — |
| Pd | 46 | 50 ($PdCl_2$) | 45 ($Pd(NO_3)_2$) | 45 ($PdSO_4$) |

TABLE 1-continued

| Metallic Element | Atomic Number | Film Strength (number of times) (Chloride) | (Nitrate) | (Sulfate) |
|---|---|---|---|---|
| Au | 79 | 30 ($AuCl_3$) | — | — |

Hygroscopic salts having metallic elements with atomic numbers of 31 or less are e.g., LiCl, LiBr, LiI, $LiNO_3$, $BeF_2$, $BeCl_2$, $BeCl_2.4H_2O$, $BeBr_2$, NaI, NaI.2-$H_2O$, $NaNO_3$, $MgCl_2$, $MgCl_2.6H_2O$, $MgBr_2$, $MgBr_2.6H_2O$, $MgI_2$, $MgI_2.8H_2O$, $Mg(NO_3)_2.6H_2O$, $AlCl_3$, $AlBr_3$, $AlBr_3.6H_2O$, $AlI_3$, KF, $KF.2H_2O$, KBr, $CaCl_2$, $CaCl_2.H_2O$, $CaCl_2.2H_2O$, $CaCl_2.6H_2O$, $CaBr_2$, $CaBr_2.6H_2O$, $CaI_2$, $CaI_2.6H_2O$, $Ca(NO_3)_2$, $Ca(NO_3)_2$,4-$H_2O$, $ScCl_3$, $ScBr_3$, $Sc(NO_3)_3$, $TiCl_3$, $TiBr_4$, $Ti(SO_4)_2$, $VF_4$, $VCl_2$, $VCl_3$, $VBr_3$, $CrCl_2$, $CrCl_3$, $CrI_2$, $MnCl_2$, $MnCl_2.4H_2O$, $MnBr_2$, $MnI_2$, $MnI_2$, $4H_2O$, $FeCl_2$, $FeCl_2.4H_2O$, $FeCl_3.6H_2O$, $FeBr_2.6H_2O$, $FeBr_3$, $FeI_2$, $FeI_2.4H_2O$, $Fe(NO_3)_3.9H_2O$, $Fe2(SO_4)_3.9H_2O$, $CoCl_2$, $CoBr_2$, $CoBr_2.6H_2O$, $CoI_2$, $CoI_2.2H_2O$, $CoI_2.6H_2O$, $Co(NO_3)_2.6H_2O$, $NiCl_2$, $NiCl_2.6H_2O$, $NiBr_2$, $NiI_2$, Ni(-$NO_3)_2.6H_2O$, $NiSO_4$, $CuCl_2$, $CuCl_2.2H_2O$, $CuBr_2$, Cu(-$NO_3)_2.3H_2O$, $Cu(NO_3)_2.6H_2O$, $ZnC_35_2$, $ZnBr_2$, $GaCl_3$, $GaBr_3$, $Ga(NO_3)_3.xH_2O$, $Ga_2(SO_4)_3$, and Ga2(-$SO4)_3.18H_2O$.

For some unknown reason, as the atomic number of metallic elements in a salt is reduced, the electric resistance of a film is further decreased and such a salt of metal with a small atomic number can provide an antistatic effect with a small content. Generally, when the content of a metal salt exceeds a given amount (10 wt % with respect to the total weight of the glass film), the strength of a film is abruptly decreased. When a film resistance of $5\times10^{10}\Omega/cm^2$ is to be obtained, a content of a metal salt up to 10 wt % is sufficient if a salt of a metal with an atomic number of 31 or less is used. If a salt of a metal with an atomic number greater than 31 is used, a content of 10 wt % or more is required, resulting in a decreased film strength.

A material constituting a skeleton of a glass film is $SiO_2$, $P_2O_5$, or a mixture thereof. These substances are preferably in the form of an alcoholate. In order to improve the film strength, B, Zr, Ti, Fe, Al, V, or the like may be contained therein.

A film according to the present invention can be obtained by dissolving one of the above-described hygroscopic metal salts in an alcoholate of the skeleton component, and coating the resultant solution on a cathode ray tube by means of a spray method, a spin method, a dip method, or the like.

Figure 3:
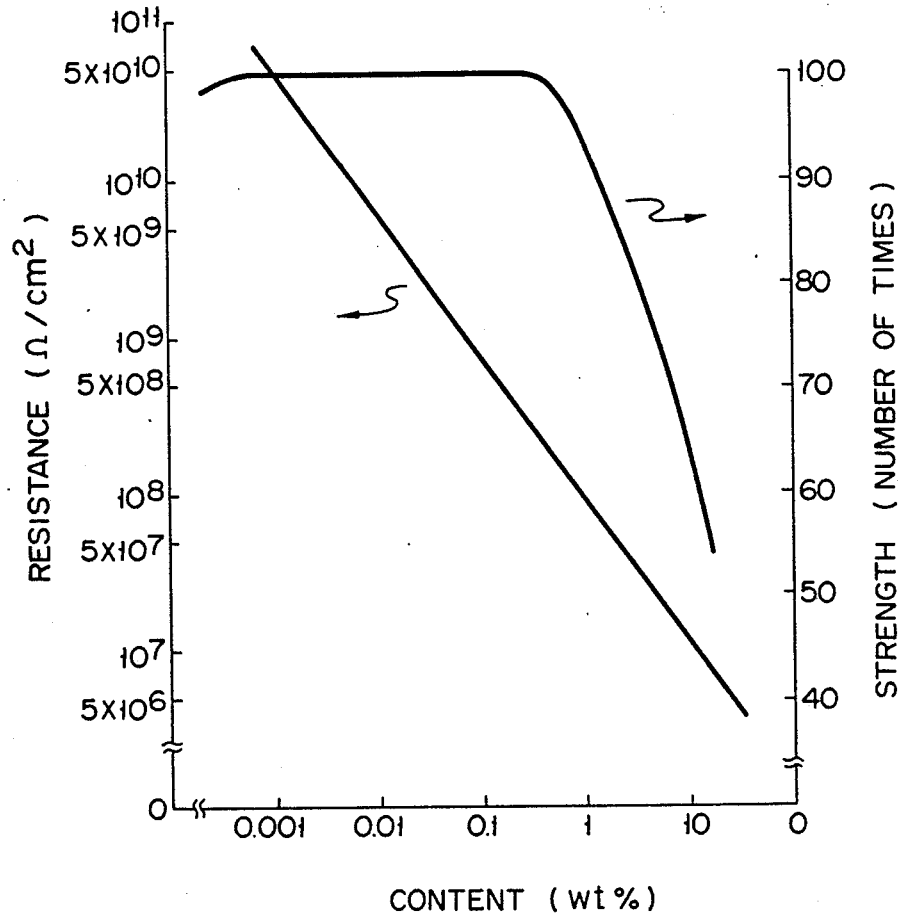
FIG. 3 is a graph showing a relationship between the content of an Li salt, and the strength and the resistance of films.

FIG. 3 shows a relationship between the contents of a metal salt with respect to a skeleton component (main component) such as $SiO_2$, and the strength and electric resistance of a corresponding film, when $LiNO_3$, which exhibits the largest antistatic effect, is used. When LiCl is used, the same figure is obtained.

Figure 4:
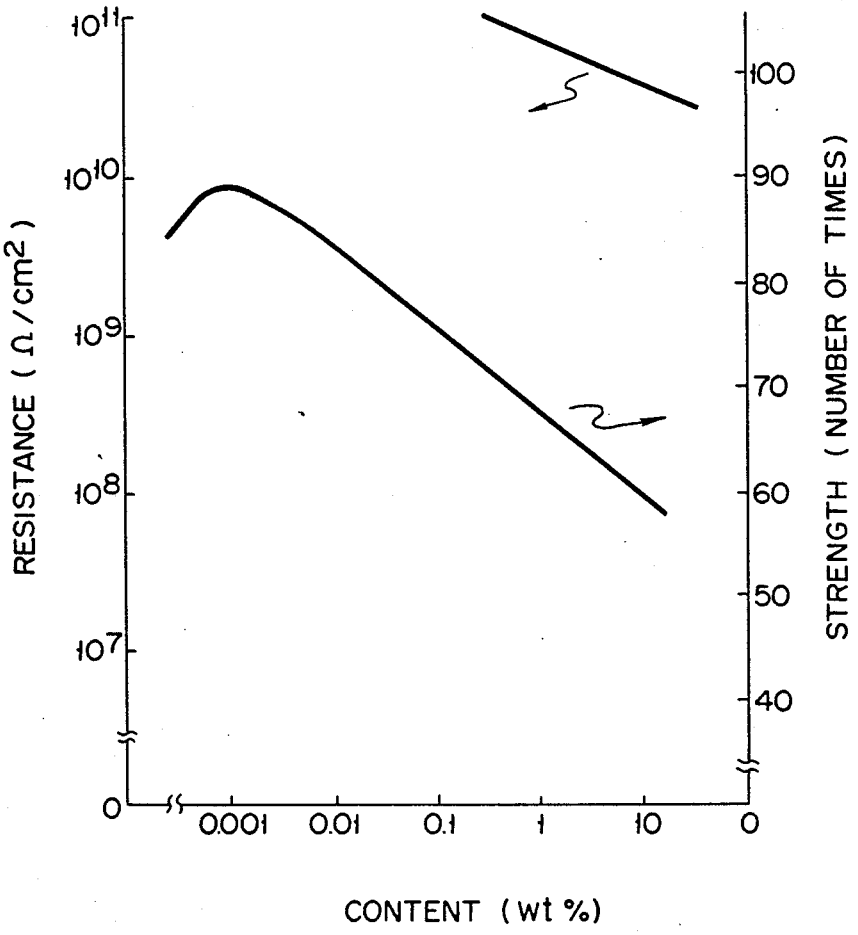
FIG. 4 is a graph showing a relationship between the content of a Ga salt, and the strength and the resistance of films.
Figure 5:
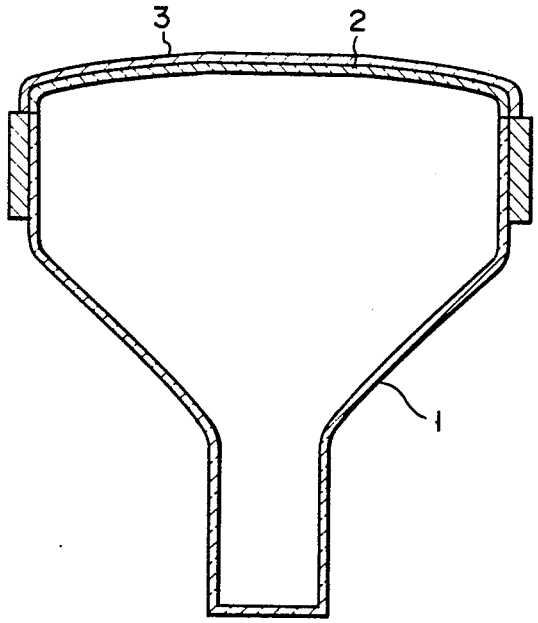
FIG. 5 shows a color picture tube including an antistatic film according to an embodiment of the present invention.

It is apparent from FIG. 3 that a content of 10 wt % or less is preferable when considering the film strength, and 0.001 wt % or more is preferable when considering the resistance of the film. FIG. 4 shows a case when $Ga(NO_3)_3$, is used. In this case, an added amount of 10 wt. % or less is preferable in consideration of strength, and 5 wt. % or more is preferable in consideration of the resistance of the film. The same figure is obtained when $GaCl_3$ or $Ga(SO_4)_3$ is used.

A more preferable range varies depending on the solubility of a metal salt to water and an alcohol (a solvent for preparing a coating solution), the molec weight, and the hygroscopicity of a metal salt.

When a glass film is formed from the solution taining a hygroscopic metal salt and a polysiloxan alcoholate of Si, the content of the hygroscopic m salt in a glass film becomes 1/10 that of the solu since the volume of the film is decreased through evaporation of a solvent or dehydrating condensa reaction during the formation of the film (the proc tion of $SiO_2$), and hence the hygroscopic metal sa caused to separate from the film. Therefore, in orde form a glass film containing 0.001 to 10 wt. % hygroscopic metal salt with respect to a main con nent, the hygroscopic metal salt must be contained glass solution in an amount of 0.01 to 100 wt % respect to $SiO_2$ stoichiometrically produced from polysiloxane or alcoholate of Si.

According to the present invention, the adhe strength of a film with respect to a cathode ray tul improved. Although the reason for this is not clea may be presumed that a dense film is formed becau metal salt is filled in the interstices of a skeleton con nent.

EXAMPLE 1

A coating solution having the following composi was prepared.

ethyl silicate . . . 5 wt. %
nitric acid . . . 3 wt %
water . . . 2 wt %
lithium nitrate . . . 0.5 wt %
isopropyl alcohol . . . balance This solution was coated on a face plate 2 of a c picture tube 1 by means of a spin method and bake 115° C. for ten minutes to form an antistatic film 3 l ing an average thickness of 0.1 μm as shown in FIC The amount of the metal salt (lithium nitrate) 3.03% with respect to the total weight of the film. antistatic film exhibited a resistance of $5\times10^8\Omega/cm$ 20° C. and 40% RH.

As a comparative example, a film without lith nitrate, and a film containing 0.01 wt % (with respec the film weight) of $SnCl_4$ using a lithium stabilized si sol disclosed in Japanese Patent Disclosure 61-16452 in place of lithium nitrate were formed to h the same thickness as that in Example 1. The resistar of these films were $5\times10^{11}$ and $2\times10^{11}\Omega/cm^2$, resp tively.

In the rubbing tests described above, the film on cathode ray tube according to the present invent exhibited a strength which could withstand a 100 more times of eraser rubbing and was superior in resistance to wear as compared to the film in the c parative example, which exhibited a strength wh could withstand a rubbing of 80 times.

EXAMPLE 2

A film was formed following the same procedure in Example 1 except that sodium nitrate was usec place of lithium nitrate. Although the film exhibite resistance of $9\times10^9\Omega/cm^2$, the antistatic effect sufficient for practical use.

EXAMPLE 3

A solution having the same composition as that Example 1 was used and coated on a faceplate of a cc picture tube by means of the spray method. Then, solution was baked at 150° C. for 30 minutes to form a film. The resistance of the film was $1\times10^{9}\Omega/cm^{2}$. In this case the film exhibited a flicker prevention effect. When the films in the comparative examples were formed by means of the spray method, the flicker prevention effect was also obtained in each film. However, their resistances were $10^{12}\Omega/cm^{2}$ or more, and $1\times10^{11}\Omega/cm^{2}$, respectively. Thus, the prominent antistatic effect of the present invention was demonstrated.

What is claimed is:

1. A cathode ray tube comprising:

an envelope having a front panel; and a glass film formed on said front panel and containing $SiO_2$ or $P_2O_5$ as a main component and a hygroscopic metal salt sealed in the interstices of the skeleton structure of said glass film.

2. A cathode ray tube according to claim 1, wherein said hygroscopic metal salt is a salt of a metallic element having an atomic number of 31 or less.

3. A cathode ray tube according to claim 1, wherein said hygroscopic metal salt is contained in said glass film in an amount of 0.001 to 10% by weight with respect to said main component.

4. A glass solution for an antistatic film of a cathode ray tube comprising:

a polysiloxane or alcoholate of Si; and a hygroscopic metal salt in an amount of 0.01 to 100% by weight with respect to $SiO_2$ stoichiometrically produced from said polysiloxane or alcoholate of Si.

5. A cathode ray tube comprising:

an envelope having a front panel; and a glass film formed on said front panel and containing $SiO_2$ or $P_2O_5$ as a main component and a hygroscopic metal salt of a metallic element having an atomic number of 31 or less sealed in the interstices of the skeleton structure of said glass film.

* * * * *